US009752216B2

(12) United States Patent
Kami et al.

(10) Patent No.: US 9,752,216 B2
(45) Date of Patent: Sep. 5, 2017

(54) HIGH-STRENGTH HOT ROLLED STEEL SHEET WITH EXCELLENT BENDABILITY AND LOW-TEMPERATURE TOUGHNESS, AND METHOD FOR MANUFACTURING THE SAME

(71) Applicant: JFE Steel Corporation, Tokyo (JP)

(72) Inventors: Chikara Kami, Tokyo (JP); Kazuhiko Yamazaki, Tokyo (JP)

(73) Assignee: JFE Steel Corporation (JP)

( * ) Notice: Subject to any disclaimer, the term of this patent is extended or adjusted under 35 U.S.C. 154(b) by 727 days.

(21) Appl. No.: 14/352,880

(22) PCT Filed: Oct. 31, 2012

(86) PCT No.: PCT/JP2012/006975

§ 371 (c)(1),
(2) Date: Apr. 18, 2014

(87) PCT Pub. No.: WO2013/065298

PCT Pub. Date: May 10, 2013

(65) Prior Publication Data

US 2014/0251513 A1 Sep. 11, 2014

(30) Foreign Application Priority Data

Nov. 1, 2011 (JP) ..... 2011-240051

(51) Int. Cl.

| | |
|---|---|
| ***C22C 38/32*** | (2006.01) |
| ***C21D 1/20*** | (2006.01) |
| ***C21D 8/02*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/00*** | (2006.01) |

(52) U.S. Cl.

CPC ..... *C22C 38/32* (2013.01); *C21D 1/20* (2013.01); *C21D 8/02* (2013.01); *C21D 8/0205* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C21D 2211/002* (2013.01); *C21D 2211/008* (2013.01)

(58) Field of Classification Search

CPC ..... C21D 1/20; C21D 2211/002; C21D 2211/008; C21D 8/02; C21D 8/0205; C21D 8/0263; C21D 9/46; C22C 38/001; C22C 38/002; C22C 38/02; C22C 38/04; C22C 38/06; C22C 38/08; C22C 38/12; C22C 38/14; C22C 38/16; C22C 38/22; C22C 38/24; C22C 38/26; C22C 38/28; C22C 38/32

USPC ..... 148/320, 330, 332, 333, 336, 337, 602

See application file for complete search history.

(56) References Cited

U.S. PATENT DOCUMENTS

| | | | | |
|---|---|---|---|---|
| 5,017,248 | A * | 5/1991 | Kawano | C22C 38/002 148/320 |
| 5,634,988 | A | 6/1997 | Kurebayashi et al. | |
| 6,364,968 | B1 | 4/2002 | Yasuhara et al. | |
| 2004/0105997 | A1* | 6/2004 | Kami | C22C 38/02 148/336 |
| 2012/0018056 | A1* | 1/2012 | Nakagawa | C21D 8/0205 148/330 |
| 2013/0061989 | A1* | 3/2013 | Nakamura | C21D 9/46 148/602 |

(Continued)

FOREIGN PATENT DOCUMENTS

| | | |
|---|---|---|
| JP | 05-230529 A | 9/1993 |
| JP | 05-345917 A | 12/1993 |

(Continued)

OTHER PUBLICATIONS

English translation of JP 2011/052321, Mar. 2011; 23 pages.*
English translation of JP 2010/174280, Aug. 2010; 12 pages.*
English translation of JP 05/345917, Dec. 1993; 8 pages.*
English translation of JP 2009/263715, Nov. 2009; 20 pages.*
English translation of JP 05/230529, Sep. 1993; 11 pages.*
English translation of JP 2006/183141, Jul. 2006; 2 pages.*
English translation of JP 2000/282175, Oct. 2000; 13 pages.*

(Continued)

*Primary Examiner* — Helene Klemanski
(74) *Attorney, Agent, or Firm* — DLA Piper LLP (US)

(57) ABSTRACT

A high-strength hot rolled steel sheet with excellent bendability and low-temperature toughness includes a chemical composition including, in mass %, C: 0.08 to 0.25%, Si: 0.01 to 1.0%, Mn: 0.8 to 2.1%, P: not more than 0.025%, S: not more than 0.005% and Al: 0.005 to 0.10%, the balance including Fe and inevitable impurities, and a microstructure having a bainite phase and/or a tempered martensite phase as a main phase, the average grain diameter of prior austenite grains being not more than 20 μm as measured with respect to a cross section parallel to a rolling direction and not more than 15 μm as measured with respect to a cross section perpendicular to the rolling direction.

16 Claims, No Drawings

(56) References Cited

U.S. PATENT DOCUMENTS

| | | | | |
|---|---|---|---|---|
| 2013/0095347 | A1* | 4/2013 | Kawasaki | C22C 38/02 148/320 |
| 2014/0096875 | A1* | 4/2014 | Ueda | C21D 8/0263 148/330 |
| 2014/0290807 | A1* | 10/2014 | Goto | C22C 38/02 148/330 |

FOREIGN PATENT DOCUMENTS

| | | | |
|---|---|---|---|
| JP | 07-138638 | A | 5/1995 |
| JP | 2000-282175 | A | 10/2000 |
| JP | 2005-314798 | A | 11/2005 |
| JP | 2006-183141 | A | 7/2006 |
| JP | 2009-263715 | A | 11/2009 |
| JP | 2010-174280 | A | 8/2010 |
| JP | 2011-52321 | | 3/2011 |
| WO | 2012/014926 | A1 | 2/2012 |
| WO | WO 2013/011791 | A1 * | 1/2013 |

OTHER PUBLICATIONS

Supplementary European Search Report dated Aug. 27, 2015 of corresponding European Application No. 12846134.0.
Korean Office Action dated Jan. 27, 2016 of corresponding Korean Application No. 2014-7011951 along with a Concise Statement of Relevance of Office Action in English.
European Communication dated Mar. 29, 2017, of corresponding European Application No. 12846134.0.

* cited by examiner

HIGH-STRENGTH HOT ROLLED STEEL SHEET WITH EXCELLENT BENDABILITY AND LOW-TEMPERATURE TOUGHNESS, AND METHOD FOR MANUFACTURING THE SAME

TECHNICAL FIELD

This disclosure relates to high-strength hot rolled steel sheets suited for structural members of construction machines and industrial machines (hereinafter, also referred to as construction and industrial machinery structural members). In particular, the disclosure pertains to improvements in bendability and low-temperature toughness. As used herein, the term "steel sheets" is defined to include steel sheets and steel strips. Further, the term "high-strength hot rolled steel sheets" is defined to refer to high-strength hot rolled steel sheets having a yield strength YS of 960 to 1200 MPa grade.

BACKGROUND

In recent years, larger construction machines such as cranes and trucks have come to be used in the construction of high-rise buildings. Industrial machines tend to be upsized too. Such trends require that the weight of these machines be reduced. Thus, there has been a demand for thin steel sheets with a high strength of not less than 960 MPa in terms of yield strength YS for use as structural members of these large-sized construction and industrial machineries.

In response to such demands, for example, Japanese Unexamined Patent Application Publication No. 5-230529 proposes a method of manufacturing high-strength hot rolled steel sheets with good workability and weldability which involves a steel slab including, in mass %, C: 0.05 to 0.15%, Si: not more than 1.50%, Mn: 0.70 to 2.50%, Ni: 0.25 to 1.5%, Ti: 0.12 to 0.30% and B: 0.0005 to 0.0015% as well as appropriate amounts of P, S, Al and N, the method including heating the steel slab to 1250° C. or above, hot rolling the slab at a temperature of from the Ar3 transformation temperature to 950° C. with a total finish reduction ratio of not less than 80%, cooling the steel sheet at a cooling rate of 30 to 80° C./s in the range of 800 to 500° C., and coiling the steel sheet at 500° C. or below. JP '529 describes that the technique allows for reliable manufacturing of high-strength hot rolled steel sheets with excellent bending workability and weldability that have a yield point of not less than 890 MPa and a tensile strength of not less than 950 MPa.

Further, Japanese Unexamined Patent Application Publication No. 5-345917 proposes a method of manufacturing high-strength hot rolled steel sheets which involves a steel slab including, in mass %, C: 0.05 to 0.20%, Si: not more than 0.60%, Mn: 0.10 to 2.50%, sol Al: 0.004 to 0.10%, Ti: 0.04 to 0.30% and B: 0.0005 to 0.0015%, the method including heating the steel slab at a heating rate of not less than 150° C./h in the temperature range of at least from 1100° C. to a heating temperature that is not less than the TiC solution treatment temperature and not more than 1400° C. while the holding time at the heating temperature is 5 to 30 minutes, and thereafter hot rolling the slab. The technique described in JP '917 utilizes a trace amount of titanium as a precipitation hardening element and a trace amount of solute boron as an austenite (γ) stabilizing element, thereby lowering the temperature at which transformation occurs during cooling, and reducing the grain size of ferrite microstructure formed after transformation. JP '917 teaches that the above configuration results in hot rolled steel sheets having high strength of about 1020 MPa in terms of tensile strength as well as high toughness of about −70° C. in terms of fracture appearance transition temperature vTrs.

Japanese Unexamined Patent Application Publication No. 7-138638 proposes a method of manufacturing high-strength hot rolled steel sheets with excellent bending workability and weldability which involves a steel slab including, in mass %, C: 0.05 to 0.15%, Si: not more than 1.50%, Mn: 0.70 to 2.50%, Ni: 0.25 to 1.5%, Ti: 0.12 to 0.30% and B: 0.0005 to 0.0015% as well as appropriate amounts of P, S, Al and N, the method including heating the steel slab to 1250° C. or above, hot rolling the slab at a temperature of from the Ar3 transformation temperature to 950° C. with a total finish reduction ratio of not less than 80%, cooling the steel sheet at a cooling rate of 20° C./s to less than 30° C./s in the range of 800 to 200° C., coiling the steel sheet at 200° C. or below, and subjecting the steel sheet to a thermo-mechanical treatment in which the steel sheet is subjected to a working strain of 0.2 to 5.0% and held at a temperature in the range of 100 to 400° C. for an appropriate time. JP '638 describes that high-strength hot rolled steel sheets having a yield point of not less than 890 MPa and a tensile strength of not less than 950 MPa may be easily manufactured according to the disclosed technique.

Further, Japanese Unexamined Patent Application Publication No. 2000-282175 describes a method of manufacturing ultrahigh-strength hot rolled steel sheets with excellent workability. That method involves a steel slab having a chemical composition which includes C: 0.05 to 0.20%, Si: 0.05 to 0.50%, Mn: 1.0 to 3.5%, P: not more than 0.05%, S: not more than 0.01%, Nb: 0.005 to 0.30%, Ti: 0.001 to 0.100%, Cr: 0.01 to 1.0% and Al: not more than 0.1% and in which the contents of Si, P, Cr, Ti, Nb and Mn satisfy a specific relationship, the method including heating the steel slab to 1100 to 1300° C. immediately after casting or after cooling, then hot rolling the slab at a finish rolling end temperature of 950 to 800° C., cooling the steel sheet at a cooling rate of not less than 30° C./s by initiating the cooling within 0.5 seconds from the completion of the rolling, and coiling the steel sheet at 500 to 300° C. According to JP '175, the above configuration results in ultrahigh-strength hot rolled steel sheets with excellent workability having a metallic microstructure containing bainite as the main phase with a volume fraction of 60 to less than 90% and at least one of pearlite, ferrite, retained austenite and martensite as the second phase, the bainite phase having an average grain diameter of less than 4 μm. In spite of the fact that the tensile strength is 980 MPa or above, the steel sheets are described as exhibiting excellent stretch flangeability and excellent strength-ductility balance as well as having a low yield ratio.

Further, Japanese Unexamined Patent Application Publication No. 2006-183141 describes a method of manufacturing high-strength hot rolled steel sheets involving a steel slab having a chemical composition containing C: 0.10 to 0.25%, Si: not more than 1.5%, Mn: 1.0 to 3.0%, P: not more than 0.10%, S: not more than 0.005%, Al: 0.01 to 0.5%, N: not more than 0.010% and V: 0.10 to 1.0% and satisfying $(10Mn+V)/C \geq 50$. That method includes heating the steel slab to 1000° C. or above, rough rolling the slab into a sheet bar, finish rolling the sheet bar at a finishing delivery temperature of not less than 800° C., cooling the steel sheet within 3 seconds after the completion of the finish rolling at an average cooling rate of not less than 20° C./s in the temperature range of 400 to 600° C. to a temperature Ta° C. satisfying $11000-3000[\%\ V] \leq \times Ta \leq 15000-1000[\%\ V]$, and coiling the steel sheet. According to JP '141, the above configuration results in high-strength hot rolled steel sheets having a microstructure in which the volume fraction of a tempered martensite phase is not less than 80%, the number of 20 nm or finer vanadium-containing carbide grains precipitated per $\mu m^3$ is not less than 1000 and the average grain diameter of the 20 nm or finer vanadium-containing carbide grains is not more than 10 nm, as well as which exhibit a tensile strength of not less than 980 MPa and excellent strength-ductility balance.

However, the techniques described in JP '529, JP '917, JP '538, JP '175 and JP '141 have difficulties in stably attaining the desired shapes as well as in realizing stable and facilitated manufacturing of hot rolled steel sheets which have a yield strength YS of not less than 960 MPa, namely, 960 MPa to 1100 MPa grade high strength, and exhibit high toughness such that the absorption energy $vE_{-40}$ according to a Charpy impact test at a test temperature of −40° C. is not less than 40 J.

It could therefore be helpful to provide high-strength hot rolled steel sheets with high toughness and excellent bendability that are suited for large-sized construction and industrial machinery structural members as well as methods of manufacturing such steel sheets. As used herein, the term "high-strength" indicates that the yield strength YS is not less than 960 MPa, the term "high toughness" indicates that $vE_{-40}$ is not less than 30 J, and preferably not less than 40 J, and the term "excellent bendability" indicates that the bending radius is not more than (3.0× sheet thickness) and that 180° bending is possible. Further, the hot rolled steel sheets are defined to be hot rolled steel sheets with a sheet thickness of 3 mm to 12 mm.

SUMMARY

We thus provide:

(1) A high-strength hot rolled steel sheet with excellent bendability and low-temperature toughness including a microstructure with a chemical composition including, in mass %, C: 0.08 to 0.25%, Si: 0.01 to 1.0%, Mn: 0.8 to 2.1%, P: not more than 0.025%, S: not more than 0.005% and Al: 0.005 to 0.10%, the balance comprising Fe and inevitable impurities, the microstructure having a bainite phase and/or a tempered martensite phase as a main phase, the average grain diameter of prior austenite grains being not more than 20 μm as measured with respect to a cross section parallel to the rolling direction and not more than 15 μm as measured with respect to a cross section perpendicular to the rolling direction.

(2) The high-strength hot rolled steel sheet described in (1), wherein the prior austenite grains have a ratio of the average length in a direction perpendicular to the rolling direction relative to the average length in the rolling direction, (average length in rolling direction)/(average length in direction perpendicular to rolling direction), of not more than 10.

(3) The high-strength hot rolled steel sheet described in (1) or (2), wherein the microstructure has an X-ray plane intensity {223}<252> of not more than 5.0.

(4) The high-strength hot rolled steel sheet described in any of (1) to (3), wherein the chemical composition further includes, in mass %, B: 0.0001 to 0.0050%.

(5) The high-strength hot rolled steel sheet described in any of (1) to (4), wherein the chemical composition further includes, in mass %, at least one selected from the group consisting of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and Ni: 0.01 to 0.50%.

(6) The high-strength hot rolled steel sheet described in any of (1) to (5), wherein the chemical composition further includes, in mass %, Ca: 0.0005 to 0.005%.

(7) A method of manufacturing high-strength hot rolled steel sheets with excellent bendability and low-temperature toughness, including subjecting a steel to a series of sequential steps including a heating step of heating the steel, a hot rolling step of subjecting the heated steel to hot rolling including rough rolling and finish rolling, a cooling step and a coiling step, thereby producing a hot rolled steel sheet, wherein the steel has a chemical composition including, in mass %, C: 0.08 to 0.25%, Si: 0.01 to 1.0%, Mn: 0.8 to 2.1%, P: not more than 0.025%, S: not more than 0.005% and Al: 0.005 to 0.10%, the balance comprising Fe and inevitable impurities, and wherein the heating step is a step in which the steel is heated to a temperature of 1100 to 1250° C., the rough rolling in the hot rolling step is rolling of the steel heated in the heating step into a sheet bar, the finish rolling in the hot rolling step is rolling of the sheet bar such that the cumulative reduction ratio in the partially recrystallized austenite region and the non-recrystallized austenite region divided by the cumulative reduction ratio in the recrystallized austenite region becomes 0 to 0.2, the cooling step includes a cooling treatment in which cooling is initiated immediately after the completion of the finish rolling and the steel sheet is cooled to a cooling termination temperature that is not more than (Ms transformation temperature+150° C.) within 30 seconds from the initiation of the cooling, the average cooling rate in the temperature range of 750° C. to 500° C. being not less than the critical cooling rate for the occurrence of martensite formation, and a holding treatment in which after the cooling treatment is terminated, the steel sheet is held at a temperature in the range of the cooling termination temperature±100° C. for 5 to 60 seconds, and the coiling step is a step in which the steel sheet is coiled into a coil at a coiling temperature in the range of (cooling termination temperature±100° C.).

(8) The method of manufacturing high-strength hot rolled steel sheets described in (7), wherein the chemical composition further includes, in mass %, B: 0.0001 to 0.0050%.

(9) The method of manufacturing high-strength hot rolled steel sheets described in (7) or (8), wherein the chemical composition further includes, in mass %, at least one selected from the group consisting of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and Ni: 0.01 to 0.50%.

(10) The method of manufacturing high-strength hot rolled steel sheets described in any of (7) to (9), wherein the chemical composition further includes, in mass %, Ca: 0.0005 to 0.005%.

Stable production is possible of hot rolled steel sheets having high strength with a yield strength YS of not less than 960 MPa and high toughness with an absorption energy of not less than 30 J according to a Charpy impact test at −40° C., as well as having excellent bendability, thus achieving marked industrial effects. Further, the hot rolled steel sheets have a sheet thickness of about 3 mm to 12 mm, the size being suited for structural members of large-sized construction machines and industrial machines. Thus, our steel sheets also make a great contribution to the reduction of body weight of construction machines and industrial machines.

DETAILED DESCRIPTION

We studied various factors that would affect the toughness and the ductility of high-strength hot rolled steel sheets having a yield strength YS of not less than 960 MPa. As a result, we found that in spite of such high strength of 960 MPa or above in terms of yield strength YS, excellent toughness and excellent bendability may be ensured by configuring the microstructure such that the main phase is bainite or tempered martensite, the average grain diameter of prior austenite (γ) grains is not more than 20 μm as measured with respect to a cross section parallel to the rolling direction, and the average grain diameter of prior γ grains is not more than 15 μm as measured with respect to a cross section perpendicular to the rolling direction.

Further, we found that higher bendability may be advantageously maintained by configuring the microstructure such that the ratio of the average length of the prior γ grains in a direction perpendicular to the rolling direction relative to the average length in the rolling direction, namely, (average length of prior γ grains in rolling direction)/(average length of prior γ grains in direction perpendicular to rolling direction) is not more than 10, or by configuring the microstructure such that the X-ray plane intensity {223}<252> (the ratio of the X-ray diffraction intensity of the {223}<252> orientation relative to a random sample) is not more than 5.0.

To obtain the above microstructure, we found that it is critical that a steel having a prescribed chemical composition be hot rolled into a steel sheet through a series of sequential steps including a heating step of heating the steel, a hot rolling step of subjecting the heated steel to hot rolling including rough rolling and finish rolling, a cooling step and a coiling step, specifically, through a series of steps including a heating step in which the steel is heated to a temperature of 1100 to 1250° C., a hot rolling step in which the steel is rough rolled into a sheet bar, which is then subjected to finish rolling such that the cumulative reduction ratio in the partially recrystallized austenite region and the non-recrystallized austenite region divided by the cumulative reduction ratio in the recrystallized austenite region becomes 0 to 0.2, a cooling step in which cooling is initiated immediately after completion of the finish rolling and the steel sheet is cooled to a cooling termination temperature that is not more than the Ms transformation temperature plus 150° C. within 30 seconds from the initiation of the cooling, the average cooling rate in the temperature range of 750° C. to 500° C. being not less than the critical cooling rate for the occurrence of martensite formation, and further in which the steel sheet is held at a temperature in the range of the cooling termination temperature±100° C. for 5 to 60 seconds, and a coiling step in which the steel sheet is coiled into a coil at a coiling temperature in the range of the cooling termination temperature±100° C.

First, the reasons why the chemical composition of our hot rolled steel sheets are limited will be described. The unit mass % will be simply referred to as % unless otherwise mentioned.

C: 0.08 to 0.25%

Carbon is an element that increases the strength of steel. To ensure the desired high strength, our steel sheets contain 0.08% or more carbon. On the other hand, excessive addition exceeding 0.25% results in a decrease in weldability as well as in a decrease in the toughness of base material. Thus, the C content is limited to 0.08 to 0.25%. Preferably, the C content is 0.10 to 0.20%.

Si: 0.01 to 1.0%

Silicon increases the strength of steel by effecting solid solution hardening and by improving hardenability. These effects are obtained by adding 0.01% or more silicon. If silicon is added in an amount exceeding 1.0%, carbon is concentrated in the γ phase and the γ phase stabilization is promoted to lower strength and, further, Si-containing oxides are formed at welds to deteriorate the quality of the welds. Thus, the Si content is limited to 0.01 to 1.0%. The Si content is preferably not more than 0.8% to suppress formation of γ phase.

Mn: 0.8 to 2.1%

Manganese increases the strength of steel sheets by improving hardenability. Further, manganese fixes sulfur by forming MnS and thereby prevents the grain boundary segregation of sulfur, thus suppressing the occurrence of cracks in slabs (steel). A Mn content of 0.8% or more is required to obtain these effects. On the other hand, a Mn content exceeding 2.1% promotes solidification segregation during slab casting and results in Mn-enriched portions in the steel sheets to increase the occurrence of separation. Elimination of such Mn-enriched portions entails heating at a temperature above 1300° C., and performing such a heat treatment on an industrial scale is not realistic. Thus, the Mn content is limited to 0.8 to 2.1%. The Mn content is preferably 0.9 to 2.0%. From the viewpoint of prevention of delayed fracturing, the Mn content is more preferably not more than 1.3%.

P: not more than 0.025%

Phosphorus is an inevitable impurity in steel and has an effect of increasing the strength of steel. However, weldability is lowered if this element is present in a content exceeding 0.025%. Thus, the P content is limited to not more than 0.025%. The P content is preferably not more than 0.015%.

S: not more than 0.005%

Similar to phosphorus, sulfur is an inevitable impurity in steel. If present in a high content exceeding 0.005%, this element causes the occurrence of slab cracks and lowers ductility by forming coarse MnS in hot rolled steel sheets. Thus, the S content is limited to not more than 0.005%. The S content is preferably not more than 0.004%.

Al: 0.005 to 0.10%

Aluminum functions as a deoxidizer. To obtain this effect, the Al content is desirably not less than 0.005%. On the other hand, any Al content exceeding 0.10% results in a marked deterioration in cleanliness at welds. Thus, the Al content is limited to 0.005 to 0.10%. The Al content is preferably not more than 0.05%.

The aforementioned components are basic components. In addition to the basic components, the chemical composition may optionally further include any of selective elements which are B: 0.0001 to 0.0050%, and/or one, or two or more of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and Ni: 0.01 to 0.50%, and/or Ca: 0.0005 to 0.005%.

B: 0.0001 to 0.0050%

Boron is an element that is segregated in γ grain boundaries and markedly improves hardenability when added in a low content. Thus, this element may be added as required to ensure the desired high strength. The B content is desirably not less than 0.0001% to obtain the above effects. On the other hand, the effects are saturated after 0.0050% and thus any further addition cannot be expected to give appropriate effects and will cause economic disadvantages. Thus, the content of boron, when added, is preferably limited to 0.0001 to 0.0050%, and more preferably 0.0005 to 0.0030%.

One, or two or more of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and Ni: 0.01 to 0.50%

Niobium, titanium, molybdenum, chromium, vanadium, copper and nickel all have an effect of increasing strength. One, or two or more of these elements may be selectively added as required.

Nb: 0.001 to 0.05%

Niobium is finely precipitated as carbonitride and increases the strength of hot rolled steel sheets in a low content without causing any deterioration in weldability. Further, this element suppresses coarsening and recrystallization of austenite grains, allowing the steel sheets to be finish rolled by hot rolling in the austenite non-recrystallization temperature region. To obtain these effects, the Nb content is desirably not less than 0.001%. On the other hand, any high content exceeding 0.05% results in an increase in rolling load during hot finish rolling and may make the practice of hot rolling difficult. Thus, the content of niobium, when added, is preferably limited to 0.001 to 0.05%, and more preferably 0.005 to 0.04%.

Ti: 0.001 to 0.05%

Titanium increases the strength of steel sheets by being finely precipitated as carbide, and also prevents the occurrence of cracks in slab (steel) by fixing nitrogen in the form of nitride. These effects are markedly obtained when the Ti content is 0.001% or above. If the Ti content exceeds 0.05%, however, the yield point is excessively increased by precipitation hardening and toughness is lowered. Further, heating at a high temperature of above 1250° C. is entailed to melt titanium carbonitride and invite the coarsening of prior γ grains, thus making it difficult to adjust the aspect ratio of prior γ grains to the desired range. Thus, the content of titanium, when added, is preferably limited to 0.001 to 0.05%, and more preferably 0.005 to 0.035%.

Mo: 0.001 to 1.0%

Molybdenum increases the strength of steel sheets by improving hardenability as well as by forming carbonitride. The Mo content is desirably not less than 0.001% to obtain these effects. If molybdenum is present in a high content exceeding 1.0%, however, weldability is lowered. Thus, the content of molybdenum, when added, is preferably limited to 0.001 to 1.0%, and more preferably 0.05 to 0.8%.

Cr: 0.01 to 1.0%

Chromium increases the strength of steel sheets by improving hardenability. The Cr content is desirably not less than 0.01% to obtain this effect. If chromium is present in a high content exceeding 1.0%, however, weldability is lowered. Thus, the content of chromium, when added, is preferably limited to 0.01 to 1.0%, and more preferably 0.1 to 0.8%.

V: 0.001 to 0.10%

Vanadium contributes to increasing the strength of steel sheets by being dissolved in steel to effect solid solution hardening. Further, this element contributes to strength increasing by being precipitated as carbide, nitride or carbonitride, namely, by precipitation hardening. The V content is desirably not less than 0.001% to obtain these effects. If vanadium is present in excess of 0.10%, however, toughness is lowered. Thus, the content of vanadium, when added, is preferably limited to 0.001 to 0.10%.

Cu: 0.01 to 0.50%

Copper contributes to strength increasing by being dissolved in steel, and also improves corrosion resistance. The Cu content is desirably not less than 0.01% to obtain these effects. However, any Cu content exceeding 0.50% results in deteriorations in surface properties of steel sheets. Thus, the content of copper, when added, is preferably limited to 0.01 to 0.50%.

Ni: 0.01 to 0.50%

Nickel contributes to strength increasing by being dissolved in steel, and also improves toughness. The Ni content is desirably not less than 0.01% to obtain these effects. However, adding nickel to a high content exceeding 0.50% results in an increase in material costs. Thus, the content of nickel, when added, is preferably limited to 0.01 to 0.50%.

Ca: 0.0005 to 0.005%

Calcium may be added as required. Calcium fixes sulfur as CaS and controls the configurations of sulfide inclusions to spherical forms. Further, this element reduces a lattice strain of the matrix around the inclusions, and lowers the hydrogen trapping ability. The Ca content is desirably not less than 0.0005% to obtain these effects. If the Ca content exceeds 0.005%, however, the amount of CaO is so increased that corrosion resistance and toughness are lowered. Thus, the content of calcium, when added, is preferably limited to 0.0005 to 0.005%, and more preferably 0.0005 to 0.0030%.

The balance after deduction of the aforementioned components is Fe and inevitable impurities. A few of such inevitable impurities and their acceptable contents are N: not more than 0.005%, O: not more than 0.005%, Mg: not more than 0.003% and Sn: not more than 0.005%.

Nitrogen is inevitably found in steel, but an excessively high content thereof increases the frequency of cracks during the casting of steel (slab). Thus, the N content is desirably limited to not more than 0.005%, and more preferably not more than 0.004%.

Oxygen is present in steel in the forms of various oxides, serving as a factor that deteriorates properties such as hot workability, corrosion resistance and toughness. It is therefore desirable that oxygen be reduced as much as possible. However, oxygen is acceptable up to 0.005%. Reducing the oxygen content to an extreme extent adds refining costs. Thus, the oxygen content is desirably reduced to 0.005% or below.

Similar to calcium, magnesium forms oxide and sulfide to suppress the formation of coarse MnS. However, the presence of this element in excess of 0.003% increases the occurrence of clusters of magnesium oxide and magnesium sulfide, resulting in a decrease in toughness. Thus, it is desirable that the Mg content be reduced to 0.003% or below.

Tin comes from steelmaking raw materials such as scraps. Tin is an element that is easily segregated in grain boundaries or the like. If this element is present in a large amount exceeding 0.005%, the grain boundary strength is lowered and the toughness is decreased. Thus, it is desirable that the Sn content be reduced to 0.005% or below.

Next, there will be described the reasons why the microstructure of the hot rolled steel sheets is limited.

The hot rolled steel sheet has the aforementioned chemical composition, and has a main phase composed of a bainite phase, a tempered martensite phase, or a mixture of a bainite phase and a tempered martensite phase. As used herein, the term "bainite" indicates bainite transformed at lower temperature. Further, the term "main phase" as used herein indicates that the phase has a volume fraction of not less than 90%, and preferably not less than 95%. This configuration of the main phase ensures that the desired high strength may be obtained. The second phase other than the main phase is a ferrite phase or a pearlite phase. Strength is decreased with increasing fraction of the second phase in the microstructure and, consequently, the desired high strength cannot be ensured. Thus, the volume fraction of the second phase is preferably not more than 10%. Needless to say, the microstructure may be sometimes a mixture containing a bainite phase or a tempered martensite phase that does not constitute the main phase, in addition to the second phase.

The microstructure has a bainite phase or a tempered martensite phase as the main phase or contains a mixture of these phases, and the average grain diameter of prior γ grains is not more than 20 μm as measured with respect to a cross section parallel to the rolling direction and the average grain diameter of prior γ grains is not more than 15 μm as measured with respect to a cross section perpendicular to the rolling direction. The microstructure having such a configuration ensures that the absorption energy $vE_{-40}$ according to a Charpy impact test at a test temperature of −40° C. will be not less than 30 J and that the hot rolled steel sheet will achieve high toughness and excellent bendability. The above toughness properties can be no longer ensured if the prior γ grains become coarse and their average grain diameter exceeds 20 μm in the L-direction cross section and exceeds 15 μm in the C-direction cross section. The average grain diameter of the prior γ grains is preferably not more than 18 μm in the L-direction cross section and not more than 13 μm in the C-direction cross section.

The microstructure is preferably such that the ratio of the average length of the prior γ grains in a direction perpendicular to the rolling direction relative to the average length of the prior γ grains in the rolling direction, namely, (average length of prior γ grains in rolling direction)/(average length of prior γ grains in direction perpendicular to rolling direction) is not more than 10. Bendability is further enhanced with this configuration. Bendability is lowered if anisotropy is so increased that (average length of prior γ grains in rolling direction)/(average length of prior γ grains in direction perpendicular to rolling direction) exceeds 10. Preferably, the ratio is not more than 7.

The average lengths of the prior γ grains are defined to be determined by image processing a microstructure picture showing the exposed prior γ grains to obtain the respective lengths of the prior γ grains in the rolling direction and in the direction perpendicular to the rolling direction, and arithmetically averaging the respective lengths.

Further, the hot rolled steel sheet is preferably such that the X-ray plane intensity {223}<252> (the ratio of the X-ray diffraction intensity of the {223}<252> orientation relative to a random sample) is not more than 5.0. If the plane intensity of {223}<252> is increased to a ratio exceeding 5.0, the anisotropy of strength is so increased that bendability is lowered. Thus, it is preferable that the plane intensity of {223}<252> of the steel sheet be not more than 5.0, and more preferably not more than 4.5. The X-ray plane intensity of {223}<252> of the steel sheet is defined to be measured by X-ray orientation distribution function (ODF) analysis at ¼ sheet thickness from the surface.

As used herein, "{223}<252>" represents X-ray orientation distribution function analytical data according to the Bunge definition, and means {223}<252> expressed by (φ1, Φ, φ2)=(30.5, 43.3, 45.0) in a cross section where φ2=45 degrees. The orientations equivalent to {223}<252> include {322}<225>, and {232}<522>. The description of {223}<252> may take such equivalent orientations into consideration. That is, {223}<252> is defined to include equivalent orientations.

Next, a preferred method of manufacturing our hot rolled steel sheets will be described.

A steel having the aforementioned chemical composition is hot rolled into a hot rolled sheet (a steel sheet) through a series of sequential steps including a heating step of heating the steel, a hot rolling step of subjecting the heated steel to hot rolling including rough rolling and finish rolling, a cooling step and a coiling step.

The steel may be manufactured by any methods without limitation. It is however preferable that a molten steel having the aforementioned chemical composition be smelted by a common smelting method such as a converter furnace method and cast into a steel material such as slab by a common casting method such as a continuous casting method.

First, the steel is subjected to a heating step.

In the heating step, the steel is heated to a temperature of 1100 to 1250° C. If the heating temperature is less than 1100° C., the deformation resistance is high and the rolling load is increased to cause an excessive load to the rolling mill. On the other hand, heating to a high temperature exceeding 1250° C. results in the coarsening of crystal grains to decrease low-temperature toughness as well as results in an increase in the amount of scales to lower the yield. Thus, the temperature to which the steel is heated is preferably 1100 to 1250° C., and more preferably not more than 1240° C.

Next, a hot rolling step is performed in which the heated steel is rough rolled into a sheet bar and the sheet bar is finish rolled into a hot rolled sheet.

The rough rolling conditions are not particularly limited as long as the steel may be rolled into a sheet bar with desired size and shape. The sheet bar thickness affects the amount of temperature decrease in the finish rolling mill. Thus, it is preferable that the sheet bar thickness be selected in consideration of the amount of temperature drop in the finish rolling mill as well as the difference between the finish rolling start temperature and the finish rolling end temperature. Since this disclosure addresses hot rolled steel sheets having a sheet thickness of about 3 mm to 12 mm, the sheet bar thickness is preferably controlled to 30 to 45 mm.

The rough rolling is followed by finish rolling, in which the sheet bar is rolled such that the cumulative reduction ratio in the partially recrystallized austenite region and the non-recrystallized austenite region divided by the cumulative reduction ratio in the recrystallized austenite region (hereinafter, this quotient value is also referred to as the cumulative reduction-ratio) becomes not more than 0.2 (including 0).

If the cumulative reduction-ratio exceeds 0.2, the prior γ grains are elongated in the rolling direction and it becomes impossible to ensure a microstructure in which the average grain diameter of prior γ grains is not more than 20 μm in a cross section parallel to the rolling direction and the average grain diameter of prior γ grains is not more than 15 μm in a cross section perpendicular to the rolling direction. Further, such rolling causes the (average length of prior γ grains in rolling direction)/(average length of prior austenite grains in direction perpendicular to rolling direction) ratio to exceed 10, and the X-ray plane intensity {223}<252> at ¼ sheet thickness from the surface to exceed 5, resulting in decreases in bendability and toughness. Thus, it is preferable that the ratio of the cumulative reduction ratio in the partial recrystallization and non-recrystallization regions during finish rolling be limited to 0.2 or below. The ratio is more preferably not more than 0.15.

To achieve the above reduction ratio during finish rolling, it is preferable, in view of the chemical composition of our steel, that the finish rolling entry (start) temperature be 900 to 1050° C., the finish rolling delivery (end) temperature be 800 to 950° C., and the difference ΔT between the finish rolling entry (start) temperature and delivery (end) temperature be not more than 200° C. Any difference ΔT larger than 200° C. indicates that the finish rolling end temperature is so low that the desired prior γ grain diameters cannot be ensured. The temperatures in finish rolling are surface temperatures.

The finish rolling in the hot rolling step is usually tandem rolling in which the time intervals between passes are short. Thus, it tends to be that the non-recrystallized γ region including the partially recrystallized γ region is shifted toward a higher temperature side and, in the case of producing thin sheets, the amount of temperature drop in the finish rolling mill is increased. To satisfy the aforementioned finish rolling conditions in a well balanced manner, it is therefore preferable that an appropriate sheet bar thickness be selected and the sheet thickness schedule (reduction schedule) control during finish rolling be optimized as well as that the amount of temperature decrease in the finish rolling mill be adjusted utilizing devices such as scale breakers and strip coolants.

After completion of the finish rolling, the steel sheet is immediately subjected to a cooling step in a cooling device disposed on the hot run table. After the completion of the finish rolling, cooling is initiated immediately, preferably within 5 seconds after the steel sheet is discharged from the finish rolling stand. If the retention time before the start of cooling is prolonged, the critical time for the occurrence of martensite formation may lapse and also the growth of γ grains proceeds with the result that the block sizes of tempered martensite phase and bainite phase become non-uniform.

In the cooling step, the steel sheet is subjected to a cooling treatment in which the sheet is cooled to a cooling termination temperature not more than (Ms transformation temperature+150° C.) with respect to a sheet thickness-wise center portion within 30 seconds from the initiation of the cooling, at a cooling rate not less than the critical cooling rate for the occurrence of martensite formation. The cooling rate is an average cooling rate of 750 to 500° C. The Ms temperature is a value calculated according to the following equation. Of the elements shown in the equation, those which are absent in the steel are regarded as zero in the calculation.

$$Ms(^\circ C.)=486-470C-8Si-33Mn-24Cr-17Ni-15Mo$$

(C, Si, Mn, Cr, Ni and Mo: contents of respective elements (mass %))

The cooling treatment is desirably initiated before the temperature of a sheet thickness-wise center portion falls below 750° C. If the temperature of a sheet thickness-wise center portion is left to fall below 750° C., ferrite (polygonal ferrite) or pearlite that is transformed at high temperature is formed during that period and, consequently, the desired microstructure cannot be obtained.

Any cooling rate that is less than the critical cooling rate for the occurrence of martensite formation cannot ensure the desired microstructure having a tempered martensite phase or a bainite phase (a lower temperature-transformed bainite phase) as the main phase or containing a mixture of these phases. The upper limit of the cooling rate is determined depending on the performance of the cooling device used. It is however preferable that a cooling rate be selected which does not involve deteriorations in the shape of steel sheets such as warpage. A more preferred cooling rate is not less than 25° C./s. In view of the chemical composition of our steel, the critical cooling rate for the occurrence of martensite formation is generally about 22° C./s.

If the cooling termination temperature is higher than (Ms temperature+150° C.), it becomes impossible to ensure the desired microstructure having a bainite phase (a lower temperature-transformed bainite phase) or a tempered martensite phase as the main phase or containing a mixture of these phases. The cooling termination temperature is preferably (Ms temperature−200° C.) to (Ms temperature+100° C.). If the cooling time from the initiation of cooling until the cooling termination temperature is reached is extended to more than 30 seconds, the fraction of second phases (ferrite, pearlite) other than the martensite phase and the bainite phase (the lower temperature-transformed bainite phase) is increased in the microstructure. Because the martensite and bainite transformation occurring at low temperatures are not allowed to proceed to a sufficient extent, the desired microstructure cannot be ensured at times.

In the cooling step, a holding treatment is carried out in which after the cooling treatment is terminated, the steel sheet is held at a temperature of (cooling termination temperature±100° C.) for 5 to 60 seconds. Through this holding treatment, the martensite and bainite phases (the lower temperature-transformed bainite phase) formed are tempered and fine cementite is precipitated in the lath. As a result, strength (yield strength) is increased and toughness improved. Further, the practice of the holding treatment prevents the occurrence of coarse cementite serving as hydrogen trapping sites, and makes it possible to prevent the occurrence of delayed fracture. If the holding temperature is less than (cooling termination temperature−100° C.), the desired tempering effects cannot be expected at times. On the other hand, holding at a temperature exceeding (cooling termination temperature+100° C.) results in excessive tempering effects and causes cementite to be coarsened, thus possibly failing to ensure the desired toughness and delayed fracture resistance.

If the holding time in the holding treatment is less than 5 seconds, the holding treatment cannot be expected to provide sufficient effects, namely, the desired tempering effects. On the other hand, the treatment for more than 60 seconds decreases the tempering effects obtained in the coiling step as well as decreases productivity.

Specifically, the holding treatment may involve methods such as induction heating. Alternatively, the holding treatment in the temperature range of (cooling termination temperature±100° C.) may be performed by utilizing heat generated by the martensite transformation on the hot run table while adjusting the amount or pressure of water in the water-cooling bank with reference to surface thermometers disposed at a plurality of locations on the hot run table.

After completion of the cooling step, the steel sheet is subjected to a coiling step in which the steel sheet is coiled into a coil at a coiling temperature of (cooling termination temperature±100° C.).

The hot rolled steel sheet is coiled into a coil and undergoes prescribed tempering in the coiling step. The desired tempering effects in the coiling step cannot be ensured if the coiling temperature is outside of (cooling termination temperature±100° C.).

Hereinbelow, our steel sheets and methods will be described in further detail based on EXAMPLES.

EXAMPLES

Slabs (steels) (thickness: 230 mm) having chemical compositions in Table 1 were subjected to a heating step and a hot rolling step described in Table 2. After completion of hot rolling, the steel sheets were sequentially subjected to a cooling step involving a cooling treatment under conditions described in Table 2 and a holding treatment described in Table 2, and to a coiling step in which the steel sheet was coiled at a coiling temperature described in Table 2. Thus, hot rolled steel sheets (steel strips) with sheet thicknesses described in Table 2 were manufactured.

Test pieces were sampled from the hot rolled steel sheets, and microstructure observation, tensile test and impact test were carried out. The testing methods were as follows.

(1) Microstructure Observation

Microstructure observation test pieces were sampled from the hot rolled steel sheet. A cross section parallel to the rolling direction (an L-direction cross section) and a cross section perpendicular to the rolling direction (a C-direction cross section) were polished and etched to expose prior γ grain boundaries, and the microstructure was observed with an optical microscope (magnification: ×500). The observation took place at ¼t sheet thickness. At least two fields of view were observed and imaged with respect to each observation site. With use of an image analyzer, the grain diameters were measured of the respective prior austenite grains in the cross section parallel to the rolling direction and in the cross section perpendicular to the rolling direction, the results being arithmetically averaged, thereby calculating the average grain diameter DL of prior austenite grains in the cross section parallel to the rolling direction and the average grain diameter DC of prior austenite grains in the cross section perpendicular to the rolling direction.

Further, the prior austenite grains were analyzed to measure the lengths in the rolling direction and the lengths in a direction perpendicular to the rolling direction. After the respective results were arithmetically averaged, the ratio R (=(average length of prior austenite grains in rolling direction)/(average length in direction perpendicular to rolling direction)) was calculated.

Furthermore, a C-direction cross section of the microstructure observation test piece was polished and was etched with Nital. With use of a scanning electron microscope (magnification: ×2000), the microstructure was observed and imaged with respect to three or more sites in a region at ¼ sheet thickness from the surface in the sheet thickness direction. The types of structures and the fractions (volume fractions) of phases in the microstructure were determined with use of an image analyzer.

Separately, the hot rolled steel sheet was ground by ¼ sheet thickness from the surface in the ND direction to give an X-ray measurement test piece. The obtained X-ray measurement test piece was chemically polished, and the working strain was removed. Thereafter, the test piece was subjected to X-ray orientation distribution function (ODF) analysis. The obtained orientation distribution function analysis results were represented according to the Bunge definition, and the X-ray intensity of the orientation {223}<252> expressed by $\phi1$, $\Phi$, $\phi2$)=(30.5, 43.3, 45.0) in a cross section where $\phi2$=45 degrees was determined.

(2) Tensile Test

Sheet-shaped test pieces (parallel widths: 25 mm, bench mark intervals: 50 mm) were sampled from a prescribed position (longitudinal coil end, ¼ in width direction) of the hot rolled steel sheet such that the longitudinal direction of the test piece would be a direction (C-direction) perpendicular to the rolling direction. A tensile test was performed at room temperature in accordance with JIS Z 2241 to determine the yield strength YS, the tensile strength TS and the total elongation E1.

(3) Impact Test

V-notched test pieces were sampled from a sheet thickness-wise center portion at a prescribed position (longitudinal coil end, ¼ in width direction) of the hot rolled steel sheet such that the longitudinal direction would be a direction (C-direction) perpendicular to the rolling direction. A Charpy impact test was performed in accordance with JIS Z 2242 to determine the absorption energy $vE_{-40}$ (J) at a test temperature of −40° C. Three test pieces were tested, and the obtained absorption energy values were arithmetically averaged, thereby obtaining the absorption energy $vE_{-40}$ (J) of the steel sheet. For those steel sheets with a sheet thickness of less than 10 mm, data measured with respect to subsize test pieces are described.

(4) Bending Test

Bending test pieces (rectangular test pieces in which the longer sides were 300 mm and perpendicular to the rolling direction, and the shorter sides were at least five times the sheet thickness) were sampled from a prescribed position of the hot rolled steel sheet. The test pieces were subjected to a 180° bending test, and the minimum bending radius was determined by measuring the minimum inner bending radius (mm) which did not cause any cracks. The minimum bending radius/sheet thickness ratio was then calculated. Those steel sheets with a minimum bending radius/sheet thickness ratio of not more than 3.0 were evaluated to be "excellent in bendability."

The results are described in Table 3.

TABLE 1

| | Chemical composition (mass %) | | | | | | | | | | Ms* | |
|---|---|---|---|---|---|---|---|---|---|---|---|---|
| Steel No. | C | Si | Mn | P | S | Al | N | B | Nb, Ti, Mo, Cr, V, Cu, Ni | Ca | (° C.) | Remarks |
| A | 0.15 | 0.01 | 1.45 | 0.011 | 0.001 | 0.047 | 0.0035 | — | — | — | 367 | Appl. Ex. |
| B | 0.07 | 0.01 | 1.50 | 0.012 | 0.002 | 0.032 | 0.0035 | — | — | — | 403 | Comp. Ex. |
| C | 0.15 | 0.01 | 2.20 | 0.011 | 0.001 | 0.047 | 0.0035 | — | — | — | 342 | Comp. Ex. |
| D | 0.18 | 0.01 | 1.41 | 0.021 | 0.001 | 0.038 | 0.0035 | — | Ti: 0.009 | — | 354 | Appl. Ex. |
| E | 0.15 | 0.01 | 1.20 | 0.011 | 0.001 | 0.035 | 0.0025 | 0.0010 | Nb: 0.020, Ti: 0.008, Cr: 0.40, Mo: 0.20 | — | 363 | Appl. Ex. |
| F | 0.15 | 0.40 | 1.20 | 0.018 | 0.001 | 0.035 | 0.0040 | 0.0010 | Nb: 0.020, Ti: 0.008, Cr: 0.50, Mo: 0.40 | — | 355 | Appl. Ex. |
| G | 0.15 | 0.20 | 1.20 | 0.011 | 0.001 | 0.035 | 0.0030 | 0.0010 | Nb: 0.020, Ti: 0.008, Cr: 0.50, Mo: 0.40, V: 0.04 | — | 356 | Appl. Ex. |

TABLE 1-continued

| Steel No. | Chemical composition (mass %) | | | | | | | | | | Ms* | |
|---|---|---|---|---|---|---|---|---|---|---|---|---|
| | C | Si | Mn | P | S | Al | N | B | Nb, Ti, Mo, Cr, V, Cu, Ni | Ca | (° C.) | Remarks |
| H | 0.17 | 0.01 | 1.20 | 0.011 | 0.001 | 0.035 | 0.0029 | 0.0010 | Nb: 0.020, Ti: 0.008, Cr: 0.50, Mo: 0.40, V: 0.04 | — | 347 | Appl. Ex. |
| I | 0.16 | 0.01 | 1.43 | 0.016 | 0.001 | 0.047 | 0.0032 | 0.0012 | — | — | 363 | Appl. Ex. |
| J | 0.16 | 0.01 | 1.20 | 0.011 | 0.001 | 0.042 | 0.0028 | 0.0012 | Mo: 0.18 | — | 363 | Appl. Ex. |
| K | 0.16 | 0.01 | 1.20 | 0.018 | 0.001 | 0.040 | 0.0028 | 0.0012 | Cr: 0.39 | — | 361 | Appl. Ex. |
| L | 0.16 | 0.01 | 1.20 | 0.011 | 0.001 | 0.047 | 0.0028 | 0.0012 | Nb: 0.021 | — | 371 | Appl. Ex. |
| M | 0.17 | 0.01 | 1.35 | 0.009 | 0.002 | 0.034 | 0.0028 | 0.0009 | Ti: 0.015, Ni: 0.35 | — | 355 | Appl. Ex. |
| N | 0.13 | 0.01 | 1.89 | 0.015 | 0.002 | 0.032 | 0.0031 | 0.0011 | Cu: 0.15 | — | 362 | Appl. Ex. |
| O | 0.14 | 0.01 | 1.78 | 0.014 | 0.001 | 0.028 | 0.0027 | 0.0009 | — | 0.0015 | 361 | Appl. Ex. |

*) Ms (° C.) = 486 − 470C − 8Si − 33Mn − 24Cr − 17Ni − 5Mo

TABLE 2

| | | Hot rolling step | | | | | | | | | Cooling Step | | | | | | | | |
|---|---|---|---|---|---|---|---|---|---|---|---|---|---|---|---|---|---|---|---|
| | | | | | Finish rolling | | | | | | | Cooling treatment | | | | Holding treatment | | | |
| | | Heating | Rough rolling | | Start | End | Reduction | Reduction | Cumu- | Finished | Time to | Average | Critical | Cooling | Time to | Holding | | Coiling step | |
| Steel sheet No. | Steel No. | temper-ature (° C.) | End temperature (° C.) | Sheet bar thickness (mm) | temper-ature (° C.) | temper-ature (° C.) | ratio in recrys-tallization region (%) | ration in nonrecrys-tallization region* (%) | lative reduction ratio ratio** | sheet thick-ness (mm) | initia-tion of cooling (s) | cooling rate*** (° C./s) | cooling rate**** (° C./s) | termination temperature (° C.) | termination of cooling (s) | temper-ature (° C.) | Holding time (s) | Coiling temperature (° C.) | Remarks |
| 1 | A | 1208 | 1032 | 36.4 | 973 | 890 | 82.7 | 3.2 | 0.04 | 6.0 | 2.9 | 100 | 50 | 364 | 5 | 325 | 25 | 329 | Ex. |
| 2 | A | 1210 | 1032 | 38.6 | 979 | 878 | 81.9 | 14.3 | 0.17 | 6.0 | 2.9 | 30 | 50 | 340 | 18 | 329 | 12 | 325 | Comp. Ex. |
| 3 | A | 1202 | 1036 | 36.9 | 983 | 892 | 81.0 | 14.3 | 0.18 | 6.0 | 2.9 | 50 | 50 | 312 | 12 | 312 | 0 | 312 | Comp. Ex. |
| 4 | B | 1208 | 1032 | 36.4 | 973 | 890 | 81.7 | 0.2 | 0.0 | 6.1 | 2.9 | 100 | 100 | 364 | 5 | 325 | 25 | 329 | Comp. Ex. |
| 5 | C | 1207 | 1035 | 36.4 | 981 | 909 | 83.2 | 0.0 | 0.0 | 6.1 | 2.9 | 60 | 19 | 364 | 9 | 325 | 21 | 329 | Comp. Ex. |
| 6 | D | 1230 | 1049 | 36.8 | 996 | 899 | 76.2 | 13.0 | 0.17 | 8.0 | 3.8 | 60 | 38 | 323 | 10 | 283 | 15 | 239 | Ex. |
| 7 | D | 1290 | 1140 | 38.8 | 1049 | 899 | 76.2 | 13.0 | 0.17 | 8.0 | 3.8 | 60 | 38 | 280 | 10 | 275 | 15 | 288 | Comp. Ex. |
| 8 | D | 1090 | 982 | 38.8 | 895 | 795 | 35.8 | 67.9 | 1.90 | 8.0 | 3.8 | 60 | 38 | 280 | 9 | 275 | 16 | 288 | Comp. Ex. |
| 9 | E | 1203 | 1036 | 36.4 | 978 | 905 | 83.5 | 0.0 | 0.0 | 8.0 | 2.9 | 30 | 24 | 260 | 22 | 240 | 12 | 236 | Ex. |
| 10 | E | 1210 | 1054 | 48.7 | 998 | 882 | 71.2 | 13.8 | 0.19 | 11.9 | 5.7 | 60 | 24 | 350 | 9 | 290 | 24 | 301 | Ex. |
| 11 | E | 1210 | 1054 | 48.7 | 998 | 882 | 67.4 | 25.2 | 0.37 | 11.9 | 5.7 | 60 | 24 | 350 | 9 | 290 | 24 | 301 | Comp. Ex. |
| 12 | F | 1203 | 1036 | 36.4 | 978 | 895 | 81.7 | 9.0 | 0.11 | 6.1 | 2.9 | 25 | 21 | 300 | 24 | 290 | 6 | 290 | Ex. |
| 13 | F | 1209 | 1035 | 30.0 | 970 | 823 | 42.7 | 65.1 | 1.52 | 6.1 | 2.9 | 30 | 21 | 300 | 17 | 290 | 13 | 290 | Comp. Ex. |
| 14 | F | 1205 | 1039 | 36.4 | 982 | 899 | 81.7 | 9.0 | 0.11 | 6.1 | 15.0 | 30 | 21 | 310 | 40 | 320 | 0 | 330 | Comp. Ex. |
| 15 | G | 1150 | 1006 | 42.6 | 936 | 892 | 77.9 | 14.9 | 0.19 | 8.0 | 3.8 | 60 | 19 | 298 | 10 | 290 | 20 | 287 | Ex. |
| 16 | G | 1250 | 1095 | 42.6 | 989 | 873 | 78.9 | 11.1 | 0.14 | 8.0 | 3.8 | 30 | 19 | 420 | 15 | 450 | 15 | 450 | Ex. |

TABLE 2-continued

| | | Hot rolling step | | | | | | | | | Cooling Step | | | | | | | | |
|---|---|---|---|---|---|---|---|---|---|---|---|---|---|---|---|---|---|---|---|
| | | | | | Finish rolling | | | | | | | Cooling treatment | | | | Holding treatment | | | |
| | | Heating | Rough rolling | | Start | End | Reduction | Reduction | Cumu- | Finished | Time to | Average | Critical | Cooling | Time to | Holding | | Coiling step | |
| Steel sheet No. | Steel No. | temper-ature (° C.) | End temperature (° C.) | Sheet bar thickness (mm) | temper-ature (° C.) | temper-ature (° C.) | ratio in recrys-tallization region (%) | ration in nonrecrys-tallization region* (%) | lative reduction ratio ratio** | sheet thick-ness (mm) | initia-tion of cooling (s) | cooling rate*** (° C./s) | cooling rate**** (° C./s) | termination temperature (° C.) | termination of cooling (s) | temper-ature (° C.) | Holding time (s) | Coiling temperature (° C.) | Remarks |
| 17 | G | 1250 | 1095 | 42.6 | 1012 | 873 | 79.0 | 10.1 | 0.13 | 8.0 | 3.8 | 20 | 19 | 418 | 23 | 319 | 7 | 320 | Ex. |
| 18 | H | 1190 | 1010 | 42.6 | 1015 | 899 | 79.1 | 10.2 | 0.13 | 8.0 | 3.8 | 30 | 14 | 497 | 13 | 397 | 25 | 320 | Ex. |
| 19 | H | 1175 | 985 | 44.5 | 1003 | 875 | 75.2 | 9.1 | 0.12 | 10.0 | 4.8 | 20 | 14 | 600 | 14 | 550 | 25 | 300 | Comp. Ex. |
| 20 | H | 1207 | 999 | 46.5 | 1003 | 893 | 78.1 | 4.0 | 0.05 | 12.0 | 5.8 | 15 | 14 | 25 | 58 | 25 | 4 | 25 | Comp. Ex. |
| 21 | I | 1180 | 1000 | 28.0 | 987 | 875 | 82.1 | 10.0 | 0.12 | 4.5 | 2.2 | 30 | 20 | 272 | 20 | 360 | 17 | 355 | Ex. |
| 22 | J | 1220 | 983 | 46.8 | 973 | 903 | 72.2 | 7.7 | 0.11 | 12.0 | 5.8 | 63 | 20 | 450 | 7 | 440 | 26 | 460 | Ex. |
| 23 | K | 1211 | 1012 | 39.8 | 979 | 891 | 72.4 | 11.8 | 0.16 | 9.7 | 4.7 | 68 | 19 | 467 | 6 | 527 | 19 | 545 | Ex. |
| 24 | L | 1232 | 1069 | 39.8 | 979 | 893 | 78.6 | 11.8 | 0.15 | 7.5 | 3.6 | 75 | 30 | 510 | 5 | 522 | 20 | 532 | Ex. |
| 25 | M | 1152 | 989 | 39.8 | 982 | 893 | 77.9 | 14.8 | 0.19 | 7.5 | 3.6 | 86 | 16 | 495 | 5 | 525 | 20 | 521 | Ex. |
| 26 | N | 1198 | 1030 | 37.8 | 983 | 883 | 76.7 | 9.1 | 0.12 | 8.0 | 3.8 | 60 | 26 | 320 | 9 | 381 | 16 | 379 | Ex. |
| 27 | O | 1203 | 1035 | 38.8 | 983 | 882 | 76.7 | 9.1 | 0.12 | 8.0 | 3.8 | 60 | 21 | 330 | 9 | 338 | 16 | 342 | Ex. |

*) Cumulative reduction ratio in non-recrystallization region including partial recrystallization region

**) (Cumulative reduction ratio in non-recrystallization region)/(Cumulative reduction ratio in recrystallization region)

***) Average cooling rate between 750-500° C.

****) Critical cooling rate for occurrence of martensite formation

TABLE 3

| Steel sheet No. | Steel No. | Microstructure: Prior γ grains* DL | DC | R | Main phase (vol %) Tempered M** | B** | Second phase (vol %) Type**: % | X-ray plane intensity*** | Mechanical characteristics: Tensile characteristics YS (Mpa) | TS (MPa) | El (%) | Toughness vE-40 (J) | Bendability: Minimum bending radius /sheet thickness | Remarks |
|---|---|---|---|---|---|---|---|---|---|---|---|---|---|---|
| 1 | A | 9.4 | 6.9 | 2.6 | 90 | 10 | | 1.9 | 1184 | 1338 | 14.8 | 48 | 2.1 | Ex. |
| 2 | A | 16.3 | 10.1 | 6.8 | | 80 | F:10, P:10 | 3.5 | 887 | 1003 | 19.8 | 64 | 2.2 | Comp. Ex. |
| 3 | A | 16.4 | 10.1 | 6.9 | 20 | 40 | F:40 | 3.5 | 796 | 1103 | 18.0 | 58 | 2.2 | Comp. Ex. |
| 4 | B | 8.1 | 5.9 | 2.0 | 95 | 5 | | 1.4 | 900 | 1017 | 19.6 | 63 | 1.7 | Comp. Ex. |
| 5 | C | 8.0 | 5.8 | 2.0 | 40 | 60 | | 1.4 | 1310 | 1481 | 13.4 | 14 | 1.7 | Comp. Ex. |
| 6 | D | 16.1 | 10.0 | 6.7 | 90 | 10 | | 3.5 | 1173 | 1326 | 15.8 | 48 | 2.2 | Ex. |
| 7 | D | 28.9 | 18.0 | 6.7 | 100 | | | 3.5 | 1169 | 1313 | 16.0 | 16 | 2.2 | Comp. Ex. |
| 8 | D | 38.4 | 17.7 | 19.1 | 100 | | | 6.8 | 1178 | 1335 | 15.7 | 48 | >5.0 | Comp. Ex. |
| 9 | E | 8.0 | 5.8 | 2.6 | 100 | | | 1.4 | 1160 | 1311 | 15.1 | 49 | 1.7 | Ex. |
| 10 | E | 17.6 | 10.5 | 7.7 | 90 | 10 | | 3.8 | 1295 | 1463 | 15.5 | 79 | 2.4 | Ex. |
| 11 | E | 32.3 | 13.4 | 18.9 | 90 | 10 | | 6.1 | 1286 | 1459 | 15.6 | 79 | >5.0 | Comp. Ex. |
| 12 | F | 12.6 | 8.7 | 4.4 | 95 | 5 | | 2.7 | 1237 | 1320 | 15.1 | 48 | 1.9 | Ex. |
| 13 | F | 26.1 | 16.3 | 17.1 | 100 | | | 6.2 | 1241 | 1335 | 14.9 | 48 | >5.0 | Comp. Ex. |
| 14 | F | 12.6 | 8.7 | 4.4 | | 20 | F:75, P:5 | 2.7 | 818 | 1122 | 17.7 | 57 | 1.9 | Comp. Ex. |
| 15 | G | 17.4 | 10.4 | 7.6 | 100 | | | 3.7 | 1363 | 1543 | 13.6 | 41 | 2.3 | Ex. |
| 16 | G | 14.3 | 9.4 | 5.5 | 10 | 90 | | 3.1 | 1297 | 1468 | 14.3 | 44 | 2.0 | Ex. |
| 17 | G | 13.6 | 9.1 | 5.0 | 10 | 90 | | 2.9 | 1108 | 1182 | 19.5 | 54 | 2.0 | Ex. |
| 18 | H | 13.6 | 9.1 | 5.0 | | 100 | | 2.9 | 1238 | 1400 | 16.5 | 46 | 2.0 | Ex. |
| 19 | H | 13.2 | 8.9 | 4.8 | | 60 | F:30, P:10 | 2.8 | 1316 | 1415 | 15.5 | 15 | 2.0 | Comp. Ex. |
| 20 | H | 10.0 | 7.3 | 2.9 | | | M:100 | 2.0 | 876 | 1401 | 16.3 | 82 | 1.8 | Comp. Ex. |
| 21 | I | 13.2 | 8.9 | 4.8 | 100 | | | 2.9 | 1013 | 1145 | 16.3 | 56 | 2.0 | Ex. |
| 22 | J | 12.4 | 8.6 | 4.3 | | 100 | | 2.7 | 1101 | 1245 | 20.1 | 62 | 1.9 | Ex. |
| 23 | K | 15.6 | 9.9 | 6.3 | | 100 | | 3.4 | 1123 | 1269 | 18.9 | 60 | 2.1 | Ex. |
| 24 | L | 14.8 | 9.6 | 5.8 | | 100 | | 3.2 | 993 | 1121 | 20.3 | 68 | 2.1 | Ex. |
| 25 | M | 17.3 | 10.4 | 7.5 | | 100 | | 3.7 | 1169 | 1320 | 17.3 | 58 | 2.3 | Ex. |
| 26 | N | 13.1 | 4.7 | 2.8 | 90 | 10 | | 2.8 | 1265 | 1430 | 16.2 | 54 | 2.0 | Ex. |
| 27 | O | 13.0 | 4.7 | 2.8 | 95 | 5 | | 2.8 | 1258 | 1421 | 16.3 | 54 | 2.0 | Ex. |

*) DL: average grain diameter (μm) of prior γ grains in cross section parallel to rolling direction, DC: average grain diameter (μm) of prior γ grains in cross section perpendicular to rolling direction, R = (average length in rolling direction)/(average length in direction perpendicular to rolling direction)
**) M: martensite, B: bainite, F: ferrite, P: pearlite
***) {223} <252>

All the hot rolled steel sheets in the Examples achieved high strength of not less than 960 MPa in terms of yield strength YS and high toughness with $vE_{-40}$ of not less than 30 J and also exhibited excellent bendability with a crack-free minimum bending radius of not more than (3.0×sheet thickness). On the other hand, Comparative Examples outside our scope resulted in hot rolled steel sheets which failed to satisfy at least one of the desired high strength, high toughness, and excellent bendability, i.e., the yield strength YS being less than 960 MPa, $vE_{-40}$ being less than 30 J and the crack-free minimum bending radius exceeding (3.0× sheet thickness).

The invention claimed is:

1. A high-strength hot rolled steel sheet with excellent bendability and low-temperature toughness comprising a chemical composition including, in mass %, C: 0.08 to 0.25%, Si: 0.01 to 1.0%, Mn: 0.8 to 2.1%, P: not more than 0.025%, S: not more than 0.005% and Al: 0.005 to 0.10%, the balance comprising Fe and inevitable impurities, and a microstructure having a bainite phase and/or a tempered martensite phase as a main phase, the average grain diameter of prior austenite grains being not more than 20 μm as measured with respect to a cross section parallel to a rolling direction and not more than 15 μm as measured with respect to a cross section perpendicular to the rolling direction, wherein the microstructure has an X-ray plane intensity {223}<252> of not more than 5.0.

2. The high-strength hot rolled steel sheet according to claim 1, wherein the prior austenite grains have a ratio of an average length in the rolling direction relative to an average length in a direction perpendicular to the rolling direction, (average length in rolling direction)/(average length in direction perpendicular to rolling direction), of not more than 10.

3. The high-strength hot rolled steel sheet according to claim 1, wherein the chemical composition further includes, in mass %, 0.0001 to 0.0050%.

4. The high-strength hot rolled steel sheet according to claim 1, wherein the chemical composition further includes, in mass %, at least one selected from the group consisting of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and 0.01 to 0.50%.

5. The high-strength hot rolled steel sheet according to claim 1, wherein the chemical composition further includes, in mass %, Ca: 0.0005 to 0.005%.

6. The high-strength hot rolled steel sheet according to claim 2, wherein the chemical composition further includes, in mass %, B: 0.0001 to 0.0050%.

7. The high-strength hot rolled steel sheet according to claim 2, wherein the chemical composition further includes, in mass %, at least one selected from the group consisting of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and Ni: 0.01 to 0.50%.

8. The high-strength hot rolled steel sheet according to claim 3, wherein the chemical composition further includes, in mass %, at least one selected from the group consisting of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and Ni: 0.01 to 0.50%.

9. The high-strength hot rolled steel sheet according to claim 1, wherein the yield strength is not less than 960 MPa.

10. A method of manufacturing high-strength hot rolled steel sheets with excellent bendability and low-temperature toughness, comprising:

subjecting a steel to a series of sequential steps including a heating step of heating the steel, a hot rolling step of subjecting the heated steel to hot rolling including rough rolling and finish rolling, a cooling step, and a coiling step, thereby producing a hot rolled steel sheet, wherein the steel has a chemical composition including, in mass %, C: 0.08 to 0.25%, Si: 0.01 to 1.0%, Mn: 0.8 to 2.1%, P: not more than 0.025%, S: not more than 0.005% and Al: 0.005 to 0.10%, the balance comprising Fe and inevitable impurities, and wherein the heating step is a step in which the steel is heated to a temperature of 1100 to 1250° C., the rough rolling in the hot rolling step is rolling of the steel heated in the heating step into a sheet bar, and the finish rolling in the hot rolling step is rolling of the sheet bar such that a cumulative reduction ratio in a partially recrystallized austenite region and a non-recrystallized austenite region divided by the cumulative reduction ratio in the recrystallized austenite region becomes 0 to 0.2, the cooling step includes a cooling treatment in which cooling is initiated immediately after completion of the finish rolling and the steel sheet is cooled to a cooling termination temperature that is not more than (Ms transformation temperature+150° C.) within 30 seconds from initiation of the cooling, the average cooling rate in a temperature range of 750° C. to 500° C. being not less than a critical cooling rate for occurrence of martensite formation, and a holding treatment in which after the cooling treatment is terminated, the steel sheet is held at a temperature of the cooling termination temperature±100° C. for 5 to 60 seconds, and the coiling step is a step in which the steel sheet is coiled into a coil at a coiling temperature of (cooling termination temperature±100° C.).

11. The method according to claim 10, wherein the chemical composition further includes, in mass %, B: 0.0001 to 0.0050%.

12. The method according to claim 10, wherein the chemical composition further includes, in mass %, at least one selected from the group consisting of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and Ni: 0.01 to 0.50%.

13. The method according to claim 10, wherein the chemical composition further includes, in mass %, Ca: 0.0005 to 0.005%.

14. The method according to claim 11, wherein the chemical composition further includes, in mass %, at least one selected from the group consisting of Nb: 0.001 to 0.05%, Ti: 0.001 to 0.05%, Mo: 0.001 to 1.0%, Cr: 0.01 to 1.0%, V: 0.001 to 0.10%, Cu: 0.01 to 0.50% and Ni: 0.01 to 0.50%.

15. The method according to claim 11, wherein the chemical composition further includes, in mass %, Ca: 0.0005 to 0.005%.

16. The method according to claim 12, wherein the chemical composition further includes, in mass %, Ca: 0.0005 to 0.005%.

* * * * *